US008517378B2

(12) United States Patent
Cha et al.

(10) Patent No.: US 8,517,378 B2
(45) Date of Patent: Aug. 27, 2013

(54) MEDIUM TRANSFER APPARATUS FOR AN AUTOMATED TELLER MACHINE

(75) Inventors: Jin Hwan Cha, Seoul (KR); Hyun-Soo Jang, Seoul (KR); Sung-Chang Hur, Seoul (KR); Dong-Sik Lee, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 77 days.

(21) Appl. No.: 13/142,197

(22) PCT Filed: Dec. 29, 2009

(86) PCT No.: PCT/KR2009/007872

§ 371 (c)(1),
(2), (4) Date: Jun. 24, 2011

(87) PCT Pub. No.: WO2010/077059

PCT Pub. Date: Jul. 8, 2010

(65) Prior Publication Data

US 2011/0260390 A1 Oct. 27, 2011

(30) Foreign Application Priority Data

Dec. 31, 2008 (KR) ..... 10-2008-0138204

(51) Int. Cl.
*B65H 5/02* (2006.01)

(52) U.S. Cl.
USPC ..... 271/273; 271/272; 399/124

(58) Field of Classification Search
USPC ..... 399/110, 124, 125; 271/264, 272, 271/273
See application file for complete search history.

(56) References Cited

U.S. PATENT DOCUMENTS

| | | | | |
|---|---|---|---|---|
| 5,106,077 | A * | 4/1992 | Kawaguchi et al. | 271/302 |
| 5,630,194 | A * | 5/1997 | Fujita et al. | 399/38 |
| 6,050,561 | A * | 4/2000 | Kidokoro et al. | 271/2 |
| 6,598,870 | B2 * | 7/2003 | Hanano | 271/138 |
| 6,628,911 | B2 * | 9/2003 | Konno | 399/124 |
| 6,772,886 | B2 * | 8/2004 | Werner et al. | 209/534 |
| 7,263,326 | B2 | 8/2007 | Amagai | |
| 7,274,897 | B2 * | 9/2007 | Katoh | 399/121 |
| 7,448,621 | B2 * | 11/2008 | Yasumoto | 271/264 |
| 7,984,907 | B2 * | 7/2011 | Chen | 271/273 |
| 2005/0056992 | A1 * | 3/2005 | Ono | 271/272 |
| 2005/0191102 | A1 | 9/2005 | Amagai | |

(Continued)

FOREIGN PATENT DOCUMENTS

| | | | |
|---|---|---|---|
| JP | 02225235 | A * | 9/1990 |
| JP | 2005-119872 | A | 5/2005 |
| JP | 2007-314258 | A | 12/2007 |
| JP | 2008-162714 | A | 7/2008 |
| KR | 20-0411492 | Y1 | 3/2006 |

OTHER PUBLICATIONS

PCT International Search Report, with English translation, PCT/KR2009/007872, Jul. 29, 2010, 4 Pages.

(Continued)

*Primary Examiner* — Kaitlin Joerger
*Assistant Examiner* — Ernesto Suarez
(74) *Attorney, Agent, or Firm* — Fenwick & West LLP

(57) ABSTRACT

The present invention relates to a medium transfer apparatus for an automated teller machine, wherein the structure for opening and shutting the medium transfer path of the medium transfer apparatus is simply formed, to thereby conveniently open and shur the medium transfer path of the medium transfer apparatus, and to conveniently and quickly prevent a jam occurring during the transfer of a paper medium performed by the medium transfer apparatus.

3 Claims, 9 Drawing Sheets

(56) References Cited

U.S. PATENT DOCUMENTS

| | | | | |
|---|---|---|---|---|
| 2007/0228646 | A1* | 10/2007 | Sekiyama et al. | 271/264 |
| 2011/0006475 | A1* | 1/2011 | Nireki | 271/264 |
| 2011/0103824 | A1* | 5/2011 | Ando et al. | 399/110 |

OTHER PUBLICATIONS

PCT International Written Opinion, with English abstract, PCT/KR2009/007872, Jul. 29, 2010, 4 Pages.

* cited by examiner

MEDIUM TRANSFER APPARATUS FOR AN AUTOMATED TELLER MACHINE

TECHNICAL FIELD

The present invention relates to a media transfer device of an automatic teller machine (ATM), and more particularly, to a media transfer device of an ATM that may readily solve a jam phenomenon occurring while the media transfer device is transferring paper media.

BACKGROUND ART

In general, an automatic teller machine (ATM) may be installed in a financial institution such as a bank and the like, to provide convenient financial services for customers without restriction on a time and an occasion. Also, the ATM may be installed in a convenient store, a public place, and the like, in addition to the financial institution. The ATM may provide a variety of financial services, for example, depositing or withdrawing of paper media such as notes and checks, checking of the balance, an account transfer, and the like. The ATM may include independently mounted various modules, for example, a depositing device, a withdrawing device, a card reader, a bankbook arrangement device, and the like. The modules may be connected to a controller and thereby, operations of the modules may be controlled by the controller.

The depositing device corresponds to a device for depositing paper media of a customer into the ATM, and the withdrawing device corresponds to a device for withdrawing paper media from the ATM for the customer. Also, a depositing and withdrawing device in which the depositing device and the withdrawing device are integrally formed may be mounted to the ATM. A media transfer device for transferring paper media may be provided in the depositing device, the withdrawing device, and the depositing and withdrawing device. Hereinafter, for ease of description, description will be made based on the media transfer device of the depositing device. However, it is only an example and thus, the description may be applicable alike to the media transfer device of the withdrawing device and the media transfer device of the depositing and withdrawing device.

Meanwhile, a jam phenomenon may occur while the media transfer device is transferring paper media. The jam phenomenon may occur due to various reasons and in general, may occur when paper media is being caught or crumpled in the media transfer device. When the jam phenomenon occurs due to such paper media, the jam phenomenon of the media transfer device may be solved by disassembling parts of the media transfer device and then removing corresponding paper media having caused the jam phenomenon.

However, in the case of the media transfer device according to a conventional art, it is difficult to verify a position in which the jam phenomenon occurs in the media transfer device. In addition, since the jam phenomenon is to be solved after disassembling the parts of the media transfer device, a corresponding work may be very inconvenient and complex. Accordingly, it is impossible to solve the jam phenomenon of the media transfer device without help from an expert. In particular, since the ATM cannot be used until the jam phenomenon of the media transfer device is solved, the efficiency of the ATM may be deteriorated.

DISCLOSURE OF INVENTION

Technical Goals

An aspect of the present invention provides a media transfer device of an automatic teller machine (ATM) that may readily and quickly solve a jam phenomenon occurring while the media transfer device is transferring paper media.

Another aspect of the present invention also provides a media transfer device of an ATM that may more simplify a structure for removing a jam from the media transfer device and may simply remove the jam even though a neighboring space of the media transfer device is very narrow.

Technical Solutions

According to an aspect of the present invention, there is provided a media transfer device of an automatic teller machine (ATM), the media transfer device including: a first transfer portion transferably supporting one surface of paper media; a second transfer portion being disposed to face the first transfer portion and to transferably support another surface of paper media, and of which a portion to face the first transfer portion is rotatably formed; an opening and closing portion being rotatably mounted to the second transfer portion and selectively rotating the facing portion in order to open and close a media transfer path formed between the first transfer portion and the second transfer portion; and a locking portion being disposed on one side of the opening and closing portion to lock an operation of the opening and closing portion when the media transfer path is closed.

Specifically, the second transfer portion may be divided into two pieces. To open and close the media transfer path formed between the first transfer portion and the second transfer portion, a portion facing the first transfer portion between the above two pieces may be rotatably formed. Accordingly, the portion of the second transfer portion facing the first transfer portion may rotate into a direction of opening the media transfer path when the opening and closing portion rotates in one direction, and may rotate to an initial position when the opening and closing portion rotates in another direction.

The first transfer portion may include a first transfer frame, first transfer rollers being drivably mounted to the first transfer frame, and a first transfer belt being mounted to the first transfer rollers to be rotatable in one direction.

The second transfer portion may include a second transfer frame being disposed to face the first transfer frame, second transfer rollers being drivably mounted to the second transfer frame, and a second transfer belt being mounted to the second transfer rollers to be rotatable in another direction and to closely contact with the first transfer belt. Here, the second transfer frame may include a rotation frame being disposed to face the first transfer frame, and a support frame rotatably supporting one side of the rotation frame.

As described above, the second transfer portion may include the rotation frame and the support frame that share the second transfer belt. In this instance, the rotation frame may be connected to the support frame to be rotatable based on one side. The present invention provides a structure of opening and closing the media transfer path by modifying a shape and a size of the second transfer portion. Accordingly, even though a neighboring space of the first and second transfer portions is too narrow to open and close the media transfer path by directly moving one of the first transfer portion and the second transfer portion, it is possible to open and close the media transfer path.

In the meantime, the rotation frame may rotate into a direction of opening the media transfer path by tension of the second transfer belt. For example, since the second transfer belt is mounted to the second transfer portion in a tensile state, the tension of the second transfer belt may act in the rotation frame into the direction of opening the media transfer path.

The opening and closing portion may include a rotation shaft being rotatably mounted to the support frame, a rotation cam being mounted to the rotation shaft and contacting with the rotation frame to rotate the rotation frame based on a rotation angle of the rotation shaft, and a knob being disposed in one end of the rotation shaft.

Specifically, when rotating the rotation shaft by a predetermined angle using the knob, the rotation cam may rotate together with the rotation axis and a contact point between the rotation cam and the rotation frame may change along a shape of the rotation cam whereby the rotation frame may rotate based on one side. That is, when the rotation frame contacts with a portion having a largest radius in the rotation cam, the rotation frame may rotate by the rotation cam into a direction in which the rotation frame may become closer to the first transfer portion whereby the first and second transfer portions may closely contact with each other. When the rotation frame contacts with a portion having a smallest radius in the rotation cam, the rotation frame may become in a state where the rotation frame may be rotatable into a direction in which the rotation frame is to be alienated from the first transfer portion. The rotation frame may rotate by the tension of the second transfer belt whereby the media transfer path may be opened.

Also, the opening and closing portion may further include an elastic member being mounted to the rotation frame and the support frame to provide the elastic force to the rotation frame into the direction of opening the media transfer path. Accordingly, when the rotation frame contacts with the portion having the smallest radius in the rotation frame, the rotation frame may rotate into the direction of opening the media transfer path by the elastic force of the elastic member as well as the tension of the second transfer belt.

A roller member making a rolling contact with the rotation cam may be provided in a portion contacting with the rotation cam of the rotation frame. Accordingly, the roller member may prevent noise and friction occurring due to interference between the rotation frame and the rotation cam, and may also smoothen a rotation manipulation of the rotation shaft.

The knob may include a grip portion being disposed in one end of the rotation shaft to rotate the rotation shaft and a guide portion being formed in the grip portion to guide rotating of the rotation shaft. A guide hole of a predetermined length may be formed in the guide portion to be inserted with the guide protrusion and thereby be passed through in order to limit a rotatable angle of the rotation shaft. In this instance, the guide protrusion may be protruded in a housing receiving the first transfer portion and the second transfer portion, or the support frame in a protruded form.

The operable range of the grip portion may be limited by the guide protrusion and the guide portion and thus, may accurately set the rotation range of the rotation cam to open and close the media transfer path.

One end of the locking portion may be elastically rotatably mounted to the guide portion or the grip portion, and another end of the locking portion may include a stopping hook being stopped by an end of the guide protrusion passing through the guide hole and thereby being stopped when the media transfer path is closed. Accordingly, when rotating the knob into a direction in which the first and second transfer portions may closely contact with each other, the locking portion may also rotate together with the guide portion of the knob whereby the stopping hook may be stopped by the guide protrusion. A stopping operation of the stopping hook and the guide protrusion may lock the operation of the opening and closing portion.

The media transfer device may further include a sensing portion being disposed on another side of the opening and closing portion to sense an open and closed state of the media transfer path. When an opening and closing state of the media transfer path is accurately sensed, the operation of the media transfer device may be appropriately controlled based on an open and closed state of the media transfer path.

The sensing portion may include a sensing plate being disposed on another end of the rotation shaft to rotate together with the rotation shaft and being formed with a slit on one side of the sensing plate, and a sensor, the sensor including a light emitter being disposed to face one side of the sensing plate, and a light receiver being disposed to face another surface of the sensing plate and to sense light of the emitter passing through the slit. The sensing plate and the sensor may be formed so that the light may be sensed at the light receiver when the media transfer path is closed, and so that the light may not be sensed at the light receiver when the rotation frame rotates into the direction in which the media transfer device is to be open.

Accordingly, when the light of the light emitter is sensed at the light receiver through a slit of the sensing plate, the media transfer device may normally operate. When the light from the light emitter is blocked by the sensing plate and thus, is not sensed at the light receiver, the operation of the media transfer device may be suspended. When the state in which the light receiver does not sense the light from the light emitter is set to a state in which it is impossible to normally operate the media transfer device, it is possible to verify a state in which the media transfer device is open and a state in which power supply to the media transfer device is suspended.

Effect of the Invention

In a media transfer device of an automatic teller machine (ATM) according to embodiments of the present invention, a portion of a second transfer portion may rotate by an opening and closing portion, whereby a media transfer path formed between the first transfer portion and the second transfer portion may be opened and closed. Accordingly, it is possible to readily and quickly solve a jam phenomenon occurring while the media transfer device is transferring paper media.

According to embodiments of the present invention, the present invention does not employ a structure of removing a jam by directly moving one of first and second transfer portions and thus, may be applicable to the media transfer device in which a neighboring space of the first and second transfer portions is very narrow.

According to embodiments of the present invention, since the media transfer path is opened and closed according to rotation of the rotation frame of the second transfer portion using the knob of the second transfer portion, an operation of removing the jam occurring in the media transfer path may be readily performed with a simple manipulation of rotating the knob of the opening and closing portion.

According to embodiments of the present invention, the rotation frame may rotate by a rotation cam mounted to a rotation shaft of the opening and closing portion and thus, a structure of rotating the rotation frame may be very simple and compact. Accordingly, the structure may be easily embodied in the media transfer device and may stably and accurately open and close the media transfer path.

According to embodiments of the present invention, since a rotation angle of the knob is appropriately limited by the guide portion and the guide protrusion, it is possible to stably open and close the media transfer path when manipulating the opening and closing portion.

According to embodiments of the present invention, since a locking portion being stopped by the guide protrusion and thereby being fixed when the media transfer path is closed is mounted to the guide portion, the locking portion may be automatically fixed to the guide protrusion with only an operation of rotating the knob of the opening and closing portion, whereby the operation of the rotation frame may be locked.

According to embodiments of the present invention, since a sensing portion to sense an open and closed state of the media transfer path, it is possible to effectively control the operation of the media transfer device based on the open and closed state of the media transfer path.

BEST MODE FOR CARRYING OUT THE INVENTION

Figure 1:
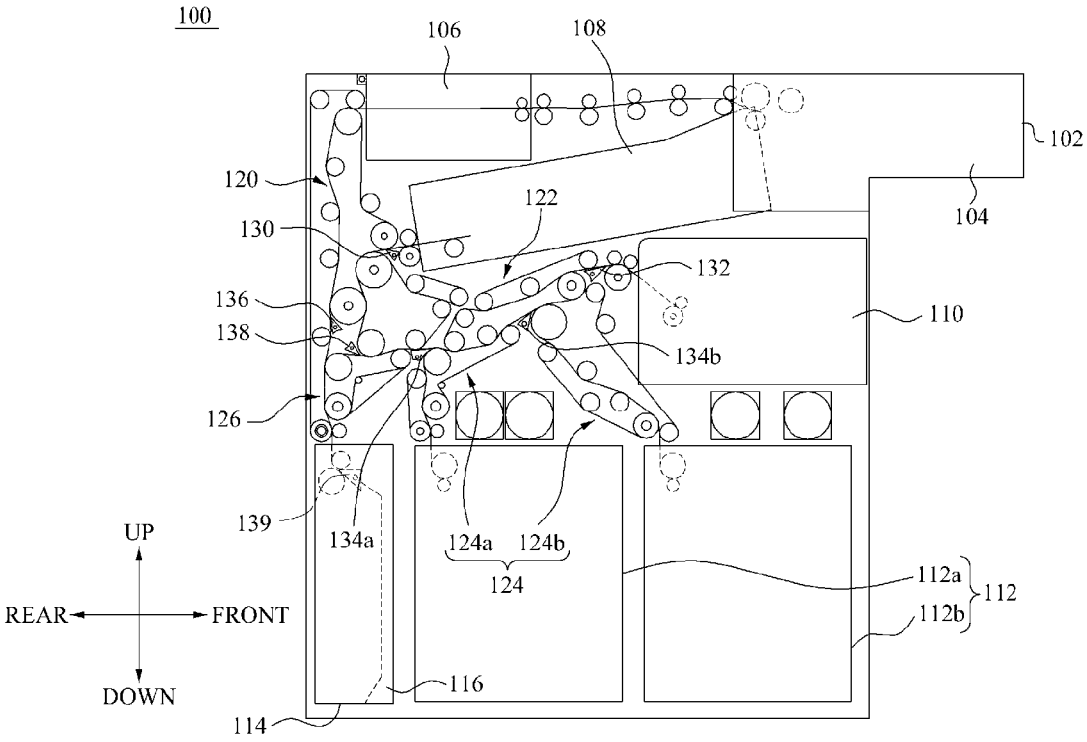
FIG. 1 is a sectional view illustrating a depositing device of an automatic teller machine (ATM) including a media transfer device according to an embodiment of the present invention.

Reference will now be made in detail to embodiments of the present invention, examples of which are illustrated in the accompanying drawings, wherein like reference numerals refer to the like elements throughout. The embodiments are described below in order to explain the present invention by referring to the figures.

Hereinafter, a media transfer device of an automatic teller machine (ATM) according to an embodiment of the present invention will be described.

Figure 2:
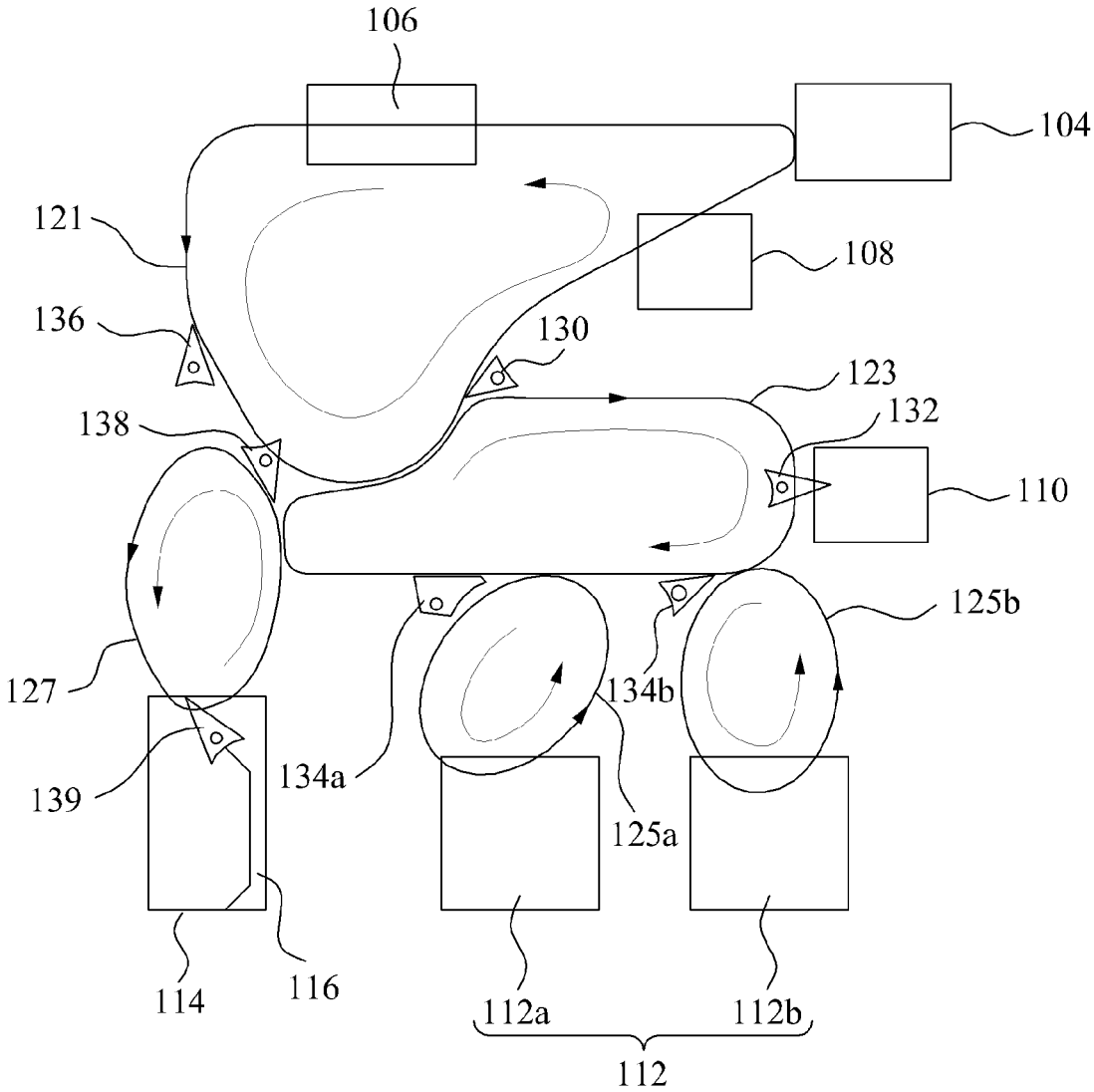
FIG. 2 is a view illustrating a media transfer path of FIG. 1.

FIG. 1 is a sectional view illustrating a depositing device 100 of an ATM including a media transfer device according to an embodiment of the present invention, and FIG. 2 is a view illustrating a media transfer path of FIG. 1.

Referring to FIG. 1, the depositing device 100 of the ATM may include a housing 102 forming an external appearance, a deposit apparatus 104 being disposed in an upper portion of the housing 102 to receive paper media of a customer, a determination apparatus 106 to determine whether the paper media received in the deposit apparatus 104 is normal or abnormal, a reject apparatus 108 to return, to the customer, paper media that is determined as abnormal paper media by the determination apparatus 106, an escrow apparatus 110 to temporarily store paper media that is determined as normal paper media by the determination apparatus 106, and a storage apparatus 112 to receive the paper media that is temporarily stored in the escrow apparatus 110.

An inlet of the deposit apparatus 104 may be disposed on a front surface of the ATM. The deposit apparatus 104 may receive paper media of the customer based on a bundle unit and transfer the paper media to the determination apparatus 106 based on a sheet unit.

To determine whether the paper media transferred from the deposit apparatus 104 is normal or abnormal, the determination apparatus 106 may include various types of sensors, an image scanner, a magnetic ink character recognition (MICR) means, and the like. The determination apparatus 106 may function to determine paper media in an abnormal state, for example, torn paper media, a plurality of overlapped paper media, partially folded paper media, and the like, and may also function to determine forged paper media.

The reject apparatus 108 may correspond to an apparatus for receiving the paper media that is determined as abnormal paper media by the determination apparatus 106, temporarily storing the paper media, and then returning the temporarily stored paper media to the deposit apparatus 104. Accordingly, since the abnormal paper media injected in the deposit apparatus 104 by means of the determination apparatus 106 and the reject apparatus 108 is transferred again to the customer, it is possible to secure stability and reliability of the ATM.

The escrow apparatus 110 may correspond to an apparatus for receiving paper media that is determined as normal paper media by the determination apparatus 106, temporarily storing the normal paper media and then, transferring the temporarily stored paper media to the storage apparatus 112. This is because when the escrow apparatus 110 collects paper media transferred based on a sheet unit and processes paper media based on a bundle unit, it is possible to increase the deposit processing efficiency. The escrow apparatus 110 may store paper media in a form to be wound around a drum (not shown) and a band (not shown), instead of storing the paper media in a stacked form.

The storage apparatus 112 may include cassettes 112*a* and 112*b* receiving the paper media temporarily stored in the escrow apparatus 110 to internally store the same. The cassettes 112*a* and 112*b* may be attachably and detachably mounted in a lower portion of the housing 102. Even though the storage apparatus 112 may provide a plurality of cassettes, for example, the cassettes 112*a* and 112*b*, the present embodiment will be described based on an example in which two cassettes 112*a* and 112*b* are provided in the depositing device 100. That is, when the first cassette 112*a* is fully filled up with paper media by initially filling paper media in the first cassette 112*a*, paper media may start filling in the second cassette 112*b*.

Referring to FIG. 1, the depositing device 100 may further include a retract apparatus 114 to retract uncollected paper media when paper media returned to the deposit apparatus 104 is not collected by the customer for at least a predetermined period of time, and a forged paper media storage apparatus 116 to store paper media that is determined as forged paper media by the determination apparatus 106.

When the paper media returned to the deposit apparatus 104 through the reject apparatus 108 is not collected for a predetermined period of time, the retract apparatus 114 may retract paper media within the deposit apparatus 104 and keep the retracted paper media.

That is, when the customer does not input a separate processing command after depositing paper media in the deposit apparatus 104, an operation of the depositing device 100 may not further progress and in this state, be left as is for a relatively long period of time. Accordingly, after returning, to the customer through the reject apparatus 108, the paper media stored in the escrow apparatus 110, the depositing device 100 may cancel depositing of the returned paper media. Also, after returning, to the customer through the reject apparatus 108, even paper media determined as abnormal paper media by the determination apparatus 106, the depositing device 100 may cancel depositing of the returned paper media.

When the costumer does not collect the paper media, returned to the deposit apparatus 104 using the reject apparatus 108, for at least a predetermined period of time, the operation of the depositing device 100 may not further progress. In addition, there is a probability that the paper media returned to the deposit apparatus 104 may be missed. Accordingly, when a special situation that the paper media returned to the deposit apparatus 104 is left as is for the at least a predetermined period of time, the paper media may be transferred from the deposit apparatus 104 to the retract apparatus 114 and the retract apparatus 114 may keep the transferred paper media.

The forged paper media storage apparatus 116 may correspond to an apparatus for retracting paper media that is determined as forged paper media by the determination apparatus 106 to thereby prevent the distribution of the forged paper media. That is, unlike paper media that is determined as other abnormal paper media by the determination apparatus 106, the forged paper media may have malicious effect on the economy and thus, it may be advantageous to the national economy to retract the forged paper media instead of returning the forged paper media to the customer. Accordingly, when the paper media is determined to be forged by the determination apparatus 106, the depositing device 100 may forcefully retract the forged paper media to the forged paper media storage apparatus 116.

Meanwhile, a circumstance where paper media is to be stored in the retract apparatus 114 and the forged paper media storage apparatus 116 does not frequently occur and limitedly occurs in a special situation. Accordingly, the retract apparatus 114 and the forged paper media storage apparatus 116 may be formed to have a relatively small capacity compared to the cassettes 112*a* and 112*b*. According to the present embodiment, the retract apparatus 114 and the forged paper media storage apparatus 116 may be formed in a single box.

Referring to FIG. 1 and FIG. 2, the depositing device 100 of the ATM according to an embodiment of the present invention may further include media transfer devices 120, 122, 124, and 126 being disposed among the deposit apparatus 104, the determination apparatus 106, the reject apparatus 108, the escrow apparatus 110, the storage apparatus 112, the retract apparatus 114, and the forged paper media storage apparatus 116 to form media transfer paths 121, 123, 125*a*, 125*b*, and 127.

The media transfer devices 120, 122, 124, and 126 may be classified into a deposit transfer apparatus 120 being provided among the deposit apparatus 104, the determination apparatus 106, and the reject apparatus 108 to form the deposit transfer path 121 through which paper media is deposited or returned, an escrow transfer device 122 being provided between the deposit transfer apparatus 120 and the escrow apparatus 110 to form an escrow transfer path 123 for temporarily storing paper media, a storage transfer apparatus 124 being provided between the escrow transfer apparatus 122 and the storage apparatus 112 to form storage transfer paths 125*a* and 125*b* for storing paper media, and a specific transfer apparatus 126 being provided among the deposit transfer apparatus 120, the escrow transfer apparatus 122, the retract apparatus 114, and the forged paper media storage apparatus 116 to form a specific transfer path 127 through which paper media is to be retracted.

The deposit transfer apparatus 120 may transfer, to the determination apparatus 106, paper media deposited in the deposit apparatus 104, may transfer, to the escrow transfer apparatus 122, paper media that is determined as normal paper media by the determination apparatus 106, and may transfer, to the reject apparatus 108, paper media that is determined as abnormal paper media by the determination apparatus 106. Here, the deposit transfer apparatus 120 and the escrow transfer apparatus 122 may be connected to partially share the deposit transfer path 121 and the escrow transfer path 123. Also, a deposit gate 130 for selectively transferring paper media to the escrow transfer apparatus 122 and the reject apparatus 108 depending on the determination result of the determination apparatus 106 may be disposed in a connection portion between the deposit transfer apparatus 120 and the escrow transfer apparatus 122.

The escrow transfer apparatus 122 may transfer, to the escrow apparatus 110, normal paper media transferred from the deposit transfer apparatus 120, and may transfer paper media temporarily stored in the escrow apparatus 110 to the storage transfer apparatus 124, the specific transfer apparatus 126, and the deposit transfer apparatus 120. An escrow gate 132 for selective entering or exiting of paper media with respect to the escrow apparatus 110 may be disposed in a connection portion between the escrow transfer apparatus 122 and the escrow apparatus 110.

The storage transfer apparatus 124 may transfer, to the storage apparatus 112, paper media transferred from the escrow transfer apparatus 122. In this instance, the storage apparatus 112 may include the first cassette 112*a* and the second cassette 112*b* and thus, the storage transfer apparatus 124 may include a first storage transfer apparatus 124*a* and a second storage transfer apparatus 124*b*. The first storage transfer apparatus 124*a* and the escrow transfer apparatus 122 may be connected to each other in a structure to partially share the first storage transfer path 125*a* and the escrow transfer path 13. The second storage transfer apparatus 124*b* and the escrow transfer apparatus 122 may be connected to each other in a structure to partially share the second storage transfer path 125*b* and the escrow transfer path 123. A first storage gate 134*a* for selectively transferring paper media to the first cassette 112*a* may be disposed in a connection portion between the first storage transfer apparatus 124*a* and the escrow transfer apparatus 122. A second storage gate 134*b* for selectively transferring paper media to the second cassette 112*b* may be disposed in a connection portion between the second storage transfer apparatus 124*b* and the escrow transfer apparatus 122.

The specific transfer apparatus 126 may transfer, to the forged paper media storage apparatus 116, paper media that is determined as forged paper media by the determination apparatus 106, and may transfer, to the retract apparatus 114, paper media that is uncollected by the customer from the deposit apparatus 104. Here, the specific transfer apparatus 126 and the deposit transfer apparatus 120 may be connected to each other in a structure to partially share the specific transfer path 127 and the deposit transfer path 121. The specific transfer apparatus 126 and the escrow transfer apparatus 122 may be connected to each other in a structure to partially share the specific transfer path 127 and the escrow transfer path 123. Also, a forged paper media gate 136 for selectively transferring forged paper media to the forged paper media storage apparatus 116 depending on the determination result of the determination apparatus 106 may be disposed in a connection portion between the specific transfer apparatus 126 and the deposit transfer apparatus 120. A retract gate 138 for selectively transferring paper media to the retract apparatus 114 may be disposed in a connection portion between the specific transfer apparatus 126 and the escrow transfer apparatus 122.

In the meantime, a specific gate 139 for selectively transferring paper media of the specific transfer apparatus 126 to the forged paper media storage apparatus 116 and the retract apparatus 114 may be disposed among the specific transfer apparatus 126, the forged paper media storage apparatus 116, and the retract apparatus 114.

Figure 3:
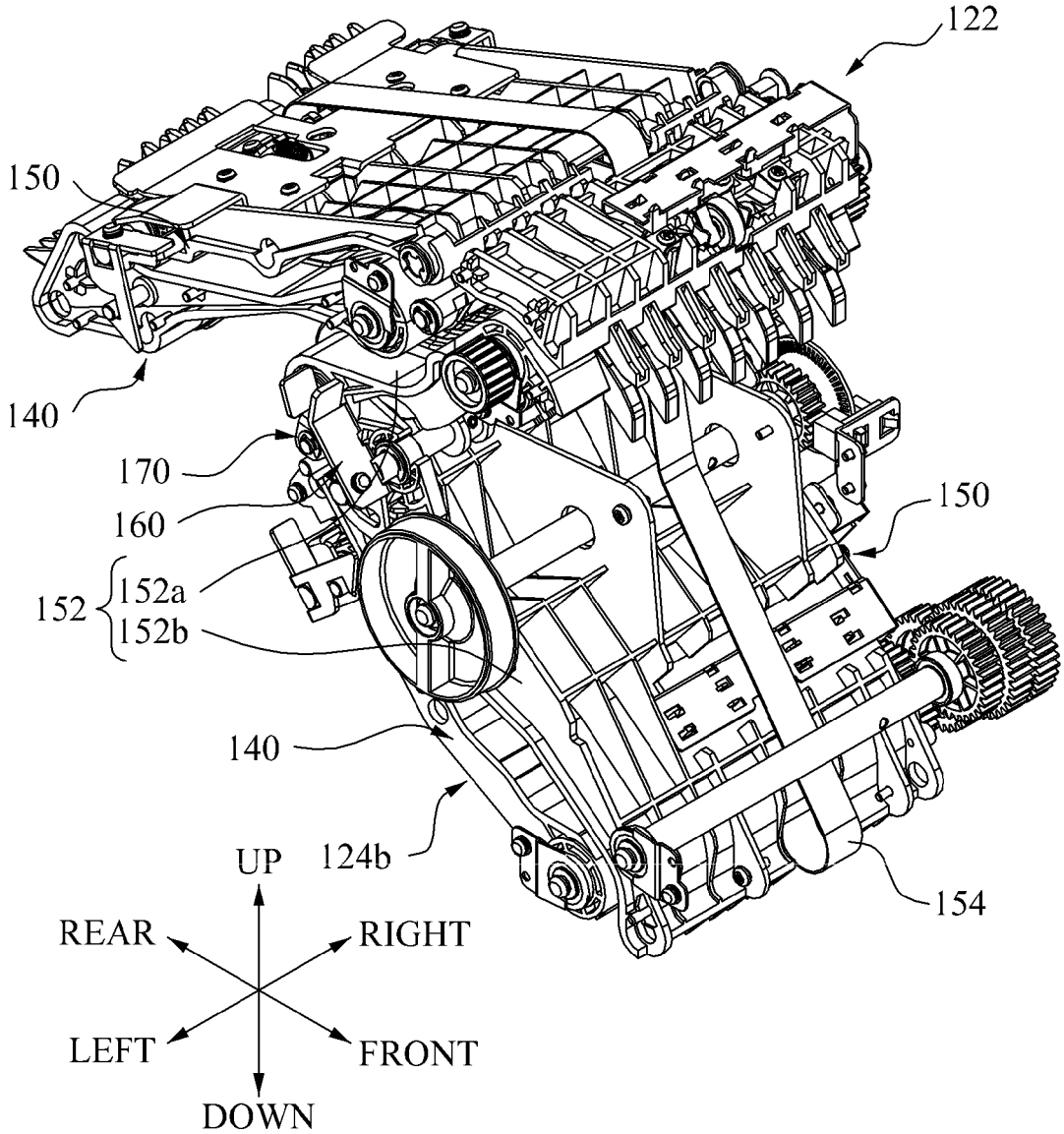
FIG. 3 is a perspective view illustrating major components of the media transfer device of FIG. 1.
Figure 4:
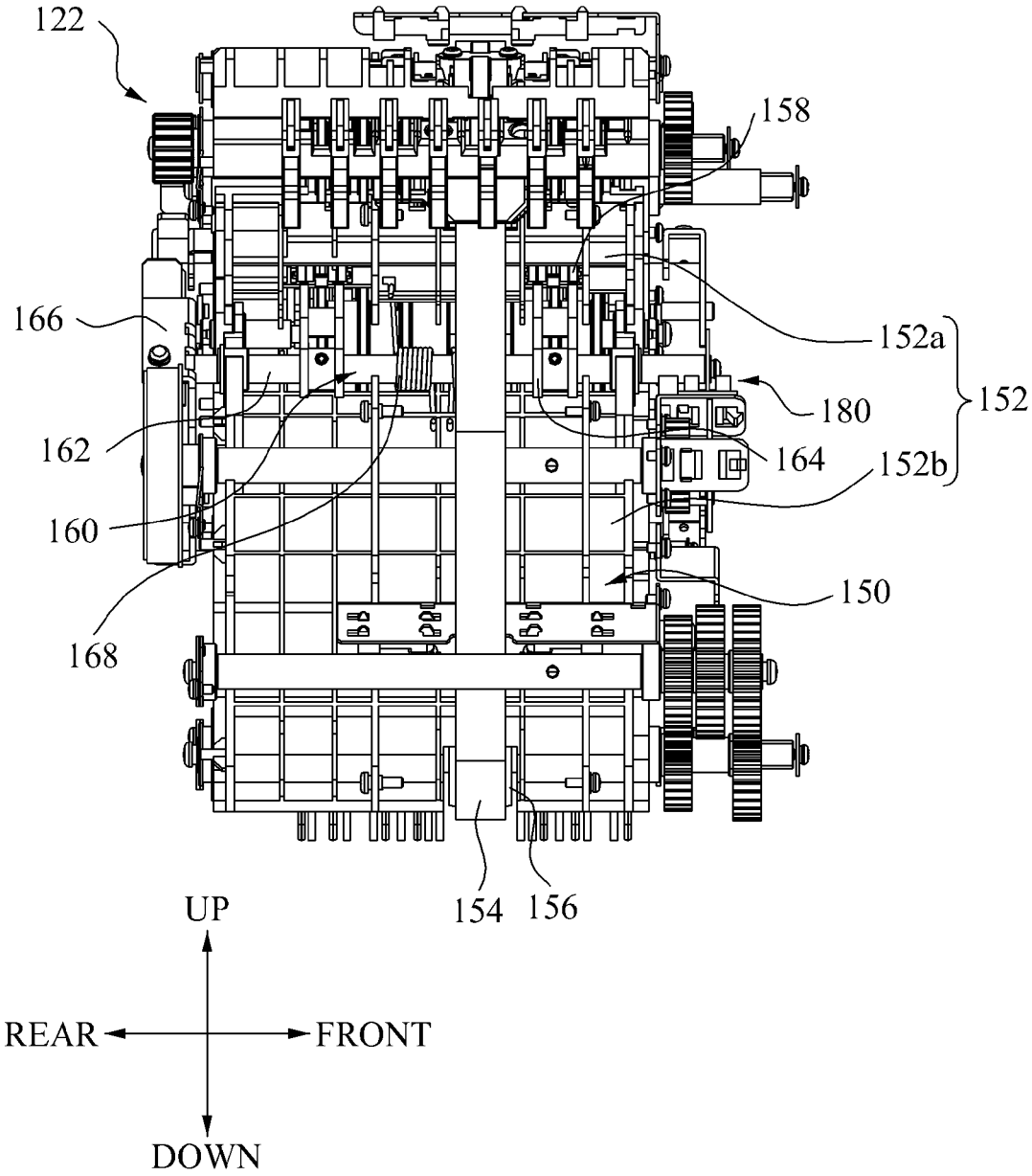
FIG. 4 is a front view illustrating the major components of the media transfer device of FIG. 3.
Figure 5:
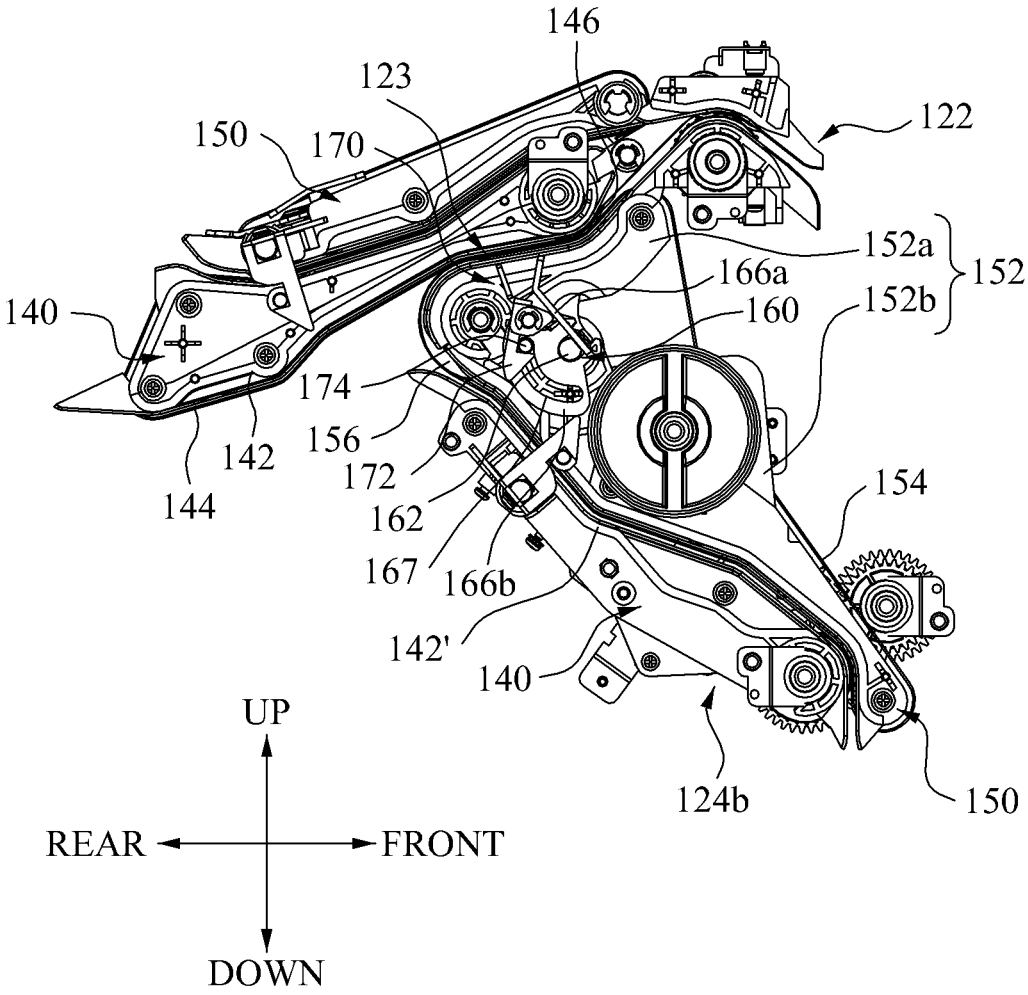
FIG. 5 is a left-side view illustrating the major components of the media transfer device of FIG. 3.
Figure 6:
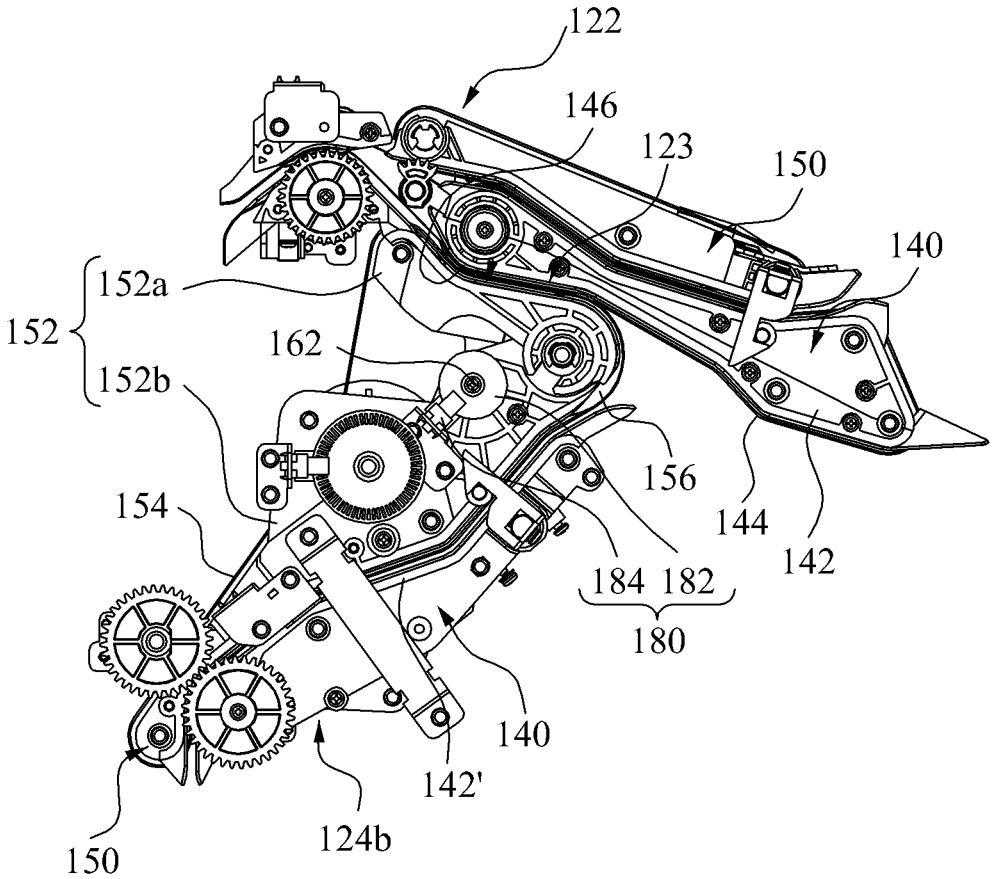
FIG. 6 is a right-side view illustrating the major components of the media transfer device of FIG. 3.
Figure 7:
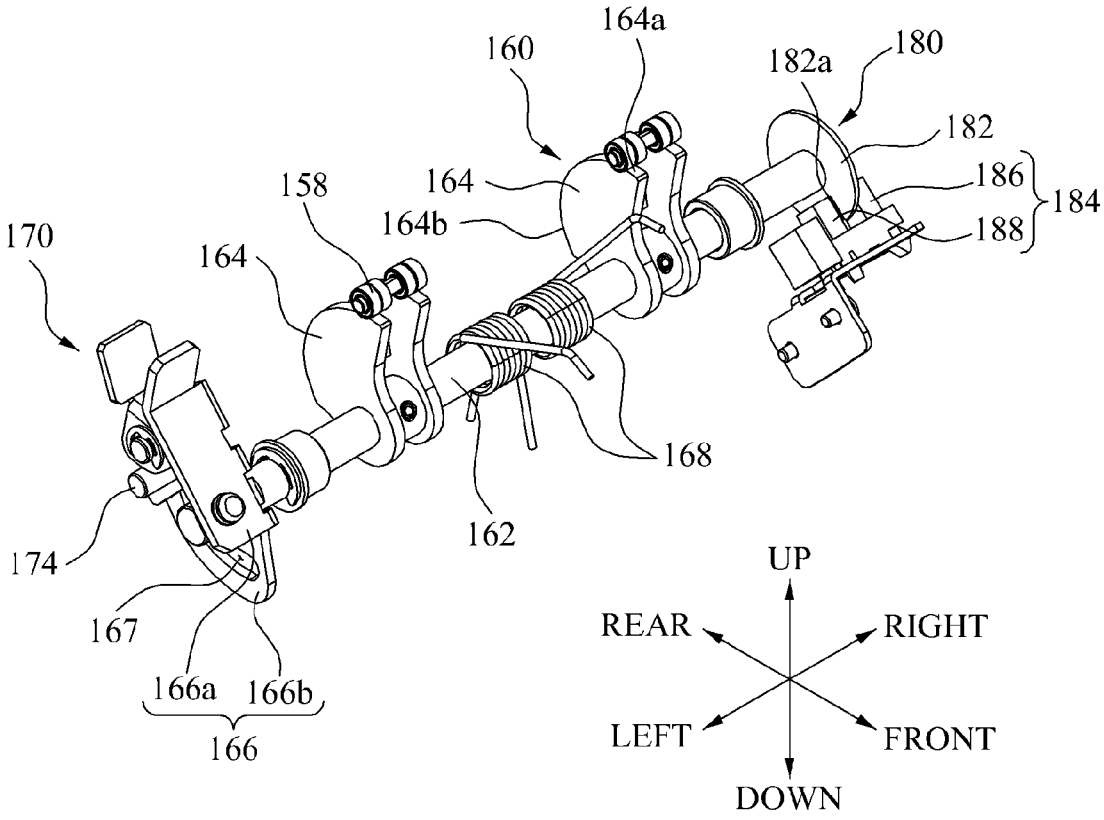
FIG. 7 is a perspective view illustrating an open and closing portion, a locking portion, and a sensing portion of FIG. 3.

FIG. 3 is a perspective view illustrating major components of the media transfer device of FIG. 1, FIG. 4 is a front view illustrating the major components of the media transfer device of FIG. 3, FIG. 5 is a left-side view illustrating the major components of the media transfer device of FIG. 3, FIG. 6 is a right-side view illustrating the major components of the media transfer device of FIG. 3, and FIG. 7 is a perspective view illustrating an open and closing portion, a locking portion, and a sensing portion of FIG. 3.

Referring to FIG. 1 through FIG. 6, the media transfer device 120, 122, 124, and 126 according to an embodiment of the present invention may include first transfer portions 140 transferably supporting one surface of paper media, and second transfer portions 150 being disposed to face the first transfer portions 140, to transferably support another surface of paper media and to form media transfer paths 121, 123, 125*a*, 125*b*, and 127 in a space with the first transfer portions 140, respectively. However, a portion of the first transfer portions 140 and the second transfer portions 150 may simultaneously perform functionalities of the first transfer portion 140 and the second transfer portion 150.

When a jam occurs, the media transfer devices 120, 122, 124, and 126, may rotate a portion of the second transfer portions 150 facing the first transfer portions 140 to thereby selectively open or close a portion of the media transfer paths 121, 123, 125*a*, 125*b*, and 127. That is, through an open or closed portion of the media transfer paths 121, 123, 125*a*, 125*b*, and 127, it is possible to exactly verify a jamming portion with bare eyes and to readily remove jammed paper media.

The above-described jam removing structure may be provided to each of portions having a relatively high jam occurrence probability in the media transfer devices 120, 122, 124, and 126. For example, portions where the deposit transfer apparatus 120, the escrow transfer apparatus 122, the first storage transfer apparatus 124*a*, the second storage transfer apparatus 124*b*, and the specific transfer apparatus 126 are connected to other components may correspond to the portions having the relatively high jam occurrence probability in the media transfer devices 120, 122, 124, and 126. Hereinafter, for ease of description, in the present embodiment, only the jam removing structure of the media transfer device 120, 122, 124, or 126 provided between the escrow transfer apparatus 122 and the escrow apparatus 110 will be described.

The first transfer portion 140 may include a first transfer frame 142 being mounted to the housing 102, a first transfer belt 144 being mounted to the first transfer frame 142 to be rotatable in one direction and to closely contact with one surface of paper media, and first transfer rollers 146 being rotatably mounted to the first transfer frame 142 to drive the first transfer belt 144.

The second transfer portion 150 may include a second transfer frame 152 being mounted to the housing 102 to face the first transfer frame 142, a second transfer belt 154 being mounted to the second transfer frame 154 to be rotatable in another direction and to closely contact with another surface of the paper media, and second transfer rollers 156 being rotatably mounted to the second transfer frame 152 to drive the second transfer belt 154.

Accordingly, paper media may be fixed by a holding force of the first transfer belts 144 and the second transfer belts 154, and the first transfer belts 144 and the second transfer belts 154 may rotate by a drive force of the first transfer rollers 146 and the second transfer rollers 156, whereby the paper media may be transferred.

The second transfer frame 152 may include a rotation frame 152*a* being disposed to face the first transfer frame 142, and a support frame 152*b* being rotatably connected to one side of the rotation frame 152*a* to rotatably support the rotation frame 152*a*. That is, the second transfer frame 152 of the second transfer portion 150 may be formed of two pieces that share the second transfer belt 154.

The rotation frame 152*a* may be formed in a shape corresponding to the first transfer frame 142. One side of the rotation frame 152*a* may be rotatably connected to the support frame 152*b* in a hinge structure. The support frame 152*b* may be fixed to the housing 102 and may be disposed to face another first transfer frame 142' that does not face the rotation frame 152*a*.

Referring to FIG. 3 through FIG. 6, the media transfer device 120, 122, 124, or 126 may further include an opening and closing portion 160 being rotatably mounted to the second transfer portion 150 to selectively rotate the rotation frame 152*a* in order to open and close the escrow transfer path 123 formed between the first transfer portion 140 and the second transfer portion 150, a locking portion 170 being mounted to one side of the opening and closing portion 160 to lock an operation of the opening and closing portion 160 when the escrow transfer path 123 is closed, and a sensing portion 180 being mounted to another side of the opening and closing portion 160 to sense an open and closed state of the escrow transfer path 123.

Referring to FIG. 3 through FIG. 7, the opening and closing portion 160 may include a rotation shaft 162 being rotatably mounted to the support frame 152*b*, a rotation cam 164 being mounted to the rotation shaft 162 and contacting with the rotation frame 152*a* to rotate the rotation frame 152*a* based on a rotation angle of the rotation shaft 162, a knob 166 being disposed in one end of the rotation shaft 162, and an elastic member 168 being mounted to the rotation frame 152*a* and the support frame 152*b* to provide the elastic force to the rotation frame 152*a* into a direction of opening the escrow transfer path 123.

The rotation shaft 162 may be mounted to the support frame 152*b* corresponding to the rotation frame 152*a* to be horizontally elongated. Both ends of the rotation shaft 162 may be mounted to both sides of the support frame 152*b* in a protruded form.

The rotation cam 164 corresponds to a cam-shaped member that rotates together with the rotation shaft 162. A plurality of rotation cams 164 may be provided on the rotation shaft 162 in the same shape and be spaced apart at predetermined intervals. The rotation cam 164 may include a first contact portion 164*a* to form the escrow transfer path 123 in a space with the first transfer portion 140 by rotating the rotation frame 152*a* into a direction of the first transfer portion 140, and a second contact portion 164*b* to open the escrow transfer path 123 by rotating the rotation frame 152*a* into a direction opposite to the first transfer portion 140. The first contact portion 164*a* may correspond to a portion having a largest radius from a rotation center of the rotation cam 164. The second contact portion 164*b* may correspond to a portion having a smallest radius from the rotation center of the rotation cam 164. The rotation shaft 162 may be connected to the rotation center of the rotation cam 164.

Meanwhile, a plurality of roller members 158 making a rolling contact with the rotation cam 164 may be provided in a portion contacting with the rotation cam 164 of the rotation frame 152*a*. Accordingly, the roller members 158 may prevent noise and friction occurring due to interference between the rotation frame 152*a* and the rotation cam 164 and may improve a manipulation sense of the rotation shaft 162 to be smooth.

The knob 166 may include a grip portion 166*a* being disposed in one end of the rotation shaft 162 to rotate the rotation shaft 162, and a guide portion 166*b* being formed in the grip portion 166*b* to guide rotating of the rotation shaft 162. The grip portion 166*a* may be formed in a panel shape that is easy to grip, and the guide portion 166*b* may be formed in a flange protruded from the grip portion 166*a*.

A guide hole 167 with a predetermined length may be formed in the guide portion 166*b* to be inserted with a guide protrusion 174 and thereby be passed through in order to limit a rotatable angle of the rotation shaft 162. The elongated guide hole 167 may be formed in an arc shape. Even though the guide protrusion 174 may be formed in the housing 102 receiving the first and second transfer portions 140 and 150 or the support frame 152*b* in a protruded form, description will be made based on an example in which the guide protrusion 174 is formed in the housing 102.

To provide the elastic force to the rotation shaft 152*a* into the direction of opening the escrow transfer path 123, both ends of the elastic member 168 may be connected to the rotation frame 152*a* and the support frame 152*b*. Even though a coil spring, a pan spring, a torsion spring, and the like may be used for the elastic member 168, description will be made based on an example in which the torsion spring is used for the elastic member 168. That is, a coil portion of the elastic member 168 may be disposed to wrap around the rotation shaft 162. Both ends of the elastic member 168 may be connected to the support frame 152*b* and the rotation shaft 152*a*, respectively. In this instance, the coil portion of the elastic member 168 may not be affected by the rotation of the rotation shaft 162 and may provide the elastic force to the support frame 152*a* into the direction of pulling the rotation frame 152*a*.

Referring to FIG. 3 through FIG. 7, one end of the locking portion 170 may be elastically rotatably mounted to the guide portion 166*b* or the grip portion 166*a*. Hereinafter, the present embodiment will be described based on an example in which the locking portion 170 is mounted to the guide portion 166*b*. Another end of the locking portion 170 may be formed with a stopping hook 172 being stopped by an end of the guide protrusion 174 passing through the guide hole 167 and thereby being fixed when the escrow transfer path 123 is closed. The locking portion 170 is not limited to the aforementioned structure and thus, may employ a variety of structures capable of locking the operation of the opening and closing portion 160.

Accordingly, when rotating the knob 166 into a direction in which the rotation frame 152*a* is to closely contact with the first transfer portion 140, the locking portion 170 may rotate together with the guide portion 166*b* of the knob 166. Due to the interference between the stopping hook 172 and the guide protrusion 174, the locking portion 170 may elastically rotate based on one end. While the stopping hook 172 is being stopped by the guide protrusion 174, the locking portion 170 may return to its initial position. Since the stopping hook 172 of the locking portion 170 is stopped by the guide protrusion 174 and thereby fixed with only an operation of rotating the knob 174 as above, the locking portion 170 may be readily used.

On the other hand, when rotating the locking portion 170 into a direction in which the stopping hook 172 is to be separated from the guide protrusion 174, the knob 166 may rotate into a direction of opening the escrow transfer path 123. The rotation frame 152*a* may rotate into the direction of opening the escrow transfer path 123 by the tension of the second transfer belt 154 and the elastic force of the elastic member 168.

Referring to FIG. 4 through FIG. 7, the sensing portion 180 may include a sensing plate 182 being disposed on another end of the rotation shaft 162 to rotate together with rotation shaft 162 and being formed with a slit 182*a* on one side of the sensing plate 182, and a sensor 184. The sensor 184 may include a light emitter 186 being disposed to face one surface of the sensing plate 182 and a light receiver 188 being disposed to face another surface of the sensing plate 182.

The sensing plate 182 may correspond to an opaque member in a circular disk form. Another end of the rotation shaft 162 may be connected to a rotation center. A single slit 182*a* transmitting light from the light emitter 186 may be formed in an edge of the sensing plate 182.

When the first transfer portion 140 and the second transfer portion 150 closely contact with each other whereby the escrow transfer path 123 is formed between the first transfer portion 140 and the second transfer portion 150, the slit 182*a* of the sensing plate 182 may be positioned between the light emitter 186 and the light receiver 188. That is, when the escrow transfer path 123 is in a closed state, the light from the light emitter 186 may be transferred to the light receiver 188 through the slit 182*a* of the sensing plate 182. When the escrow transfer path 123 is in an open state, the light from the light emitter 186 may be blocked by the sensing plate 182.

Accordingly, when the light of the light emitter 186 is sensed at the light receiver 188, the escrow transfer path 123 may be determined to be in the closed state, thereby normally operating the media transfer device 120, 122, 124, or 126. When the light of the light emitter 186 is not sensed at the light receiver 188, the escrow transfer path 123 may be determined to be in the open state, thereby suspending the operation of the media transfer device 120, 122, 124, or 126. Setting the state in which the light of the light emitter 186 is transferred to the light receiver 188 to the state in which the media transfer device 120, 122, 124, or 126 normally operate is because it is possible to suspend the operation of the media transfer device 120, 122, 124, or 126 even when supply of power to the media transfer device 120, 122, 124, or 126 is suspended as well as when the escrow transfer path 123 is in the open state.

Hereinafter, an operation process and a jam removing method of the media transfer device 120, 122, 124, or 126 according to an embodiment of the present invention constructed as above will be described. FIG. 5 and FIG. 6 are views sequentially illustrating a process of opening a portion of a media transfer path according to an embodiment of the present invention.

The operation process of the media transfer device 120, 122, 124, or 126 will be described. Initially, when a customer inputs paper media in the deposit apparatus 104, the deposit transfer apparatus 120 may transfer the paper media to the determination apparatus 106 based on a sheet unit and the determination apparatus 106 may determine whether the paper media is normal. Paper media determined as forged paper media by the determination apparatus 106 may be transferred from the deposit transfer apparatus 120 to the specific transfer apparatus 126 through the forged paper media gate 136 and then, pass the specific gate 139 and be received in the forged paper media storage apparatus 116.

Paper media determined as normal paper media by the determination apparatus 106 may be transferred from the deposit transfer apparatus 120 to the escrow transfer apparatus 122 through the deposit gate 130, and pass the escrow gate 132 from the escrow transfer apparatus 122 and be temporarily stored in the escrow apparatus 110. Paper media temporarily stored in the escrow apparatus 110 may be transferred to the escrow transfer apparatus 122 through the escrow gate 132, be transferred from the escrow transfer apparatus 122 to the first storage transfer apparatus 124*a* through the first storage gate 134*a*, and be received in the first cassette 112*a* through the first storage transfer apparatus 124*a*. When the first cassette 112*a* is filled up with paper media to its maximum capacity, paper media of the escrow transfer apparatus 122 may be transferred to the second storage transfer apparatus 124 through the second storage gate 134*b* and be received in the second cassette 112*b* through the second storage transfer apparatus 124*b*.

However, when processing of the paper media temporarily stored in the escrow apparatus 110 is delayed for a relatively long period of time, the paper media temporarily stored in the escrow apparatus 110 may be transferred to the reject apparatus 108 through the escrow gate 132, the escrow transfer apparatus 122, and the deposit gate 130. The paper media of the reject apparatus 108 may be returned to the deposit apparatus 104. Also, paper media determined as abnormal paper media by the determination apparatus 106 may be transferred from the deposit transfer apparatus 120 to the reject apparatus 108 through the deposit gate 130. The paper media of the reject apparatus 108 may be returned to the deposit apparatus 104.

When the customer does not collect the paper media returned to the deposit apparatus 104 for at least a predetermined period of time, the paper media may be retracted to the escrow apparatus 110 through the deposit transfer apparatus 120, the deposit gate 130, the escrow transfer apparatus 122, and the escrow gate 132. The paper media retracted in the escrow apparatus 110 may be received in the retract apparatus 114 through the escrow gate 132, the escrow transfer apparatus 122, the retract gate 138, the specific transfer apparatus 126, and the specific gate 139.

When a jam occurs during the aforementioned process of transferring paper media in the media transfer device 120, 122, 124, or 126, an operation of the media transfer device 120, 122, 124, or 126 may be suspended, which results in suspending a depositing function of the depositing device 100. Accordingly, to quickly remove the jam in the media transfer device 120, 122, 124, or 126, thereby quickly recovering the function of the depositing device 100, may become an important issue in the efficiency aspect.

Hereinafter, a method of removing the jam in the media transfer device 120, 122, 124, or 126 will be described. After opening the media transfer path 121, 123, 125*a*, 125*b*, or 127 by rotating the portion of the second transfer portion 150 disposed in the media transfer device 120, 122, 124, or 126, facing the first transfer portion 140, to be alienated from the first transfer portion 140, and after verifying the jamming portion in the media transfer path 121, 123, 125*a*, 125*b*, or 127 with bare eyes, jammed paper media may be removed from the media transfer path 121, 123, 125*a*, 125*b*, or 127.

Hereinafter, for ease of description, detailed description will be made based on the second transfer portion 150 disposed in the connection portion between the escrow transfer apparatus 122 and the escrow apparatus 110.

Figure 8:
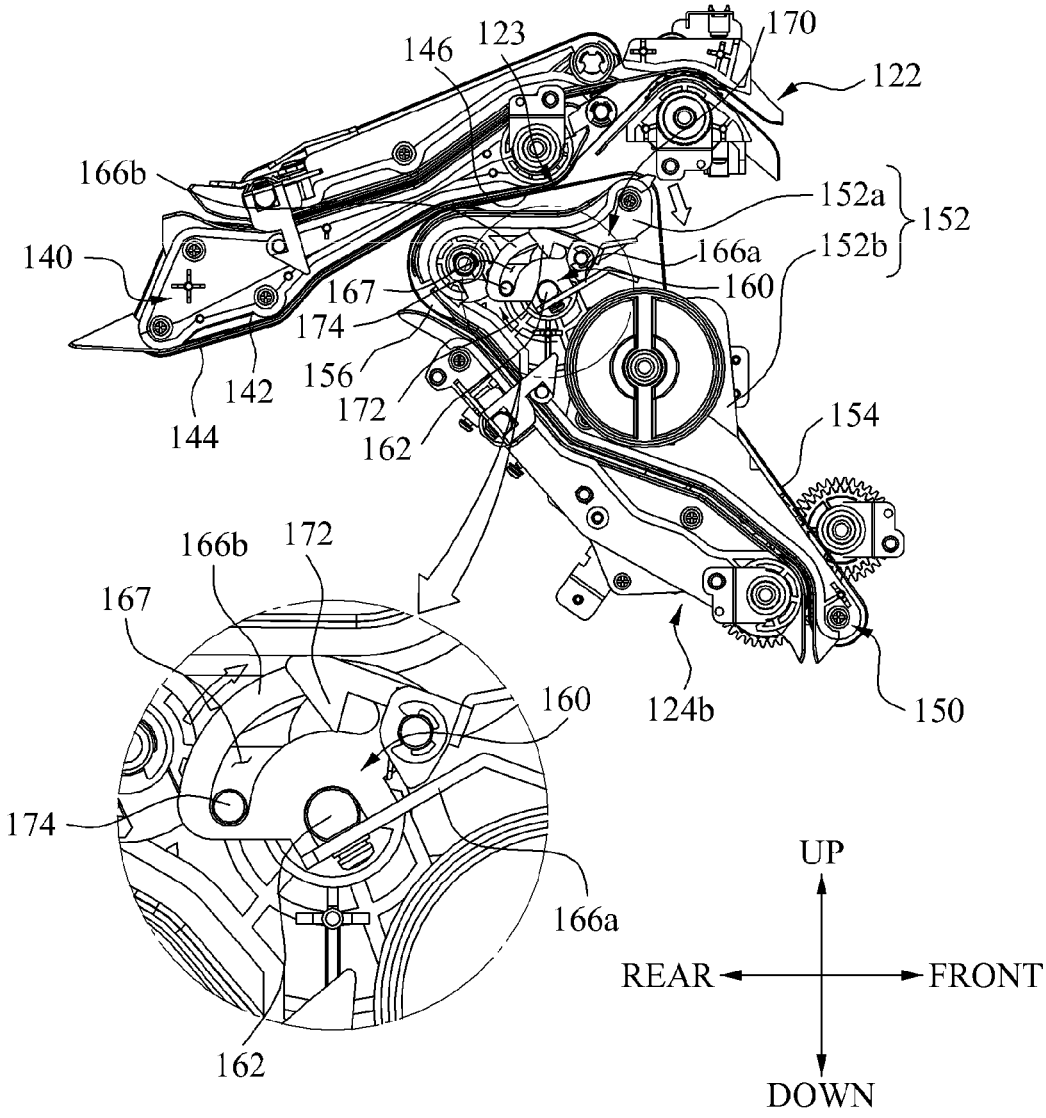
FIG. 8 and FIG. 9 are operation state views sequentially illustrating a process of opening a portion of a media transfer path according to an embodiment of the present invention.
Figure 9:
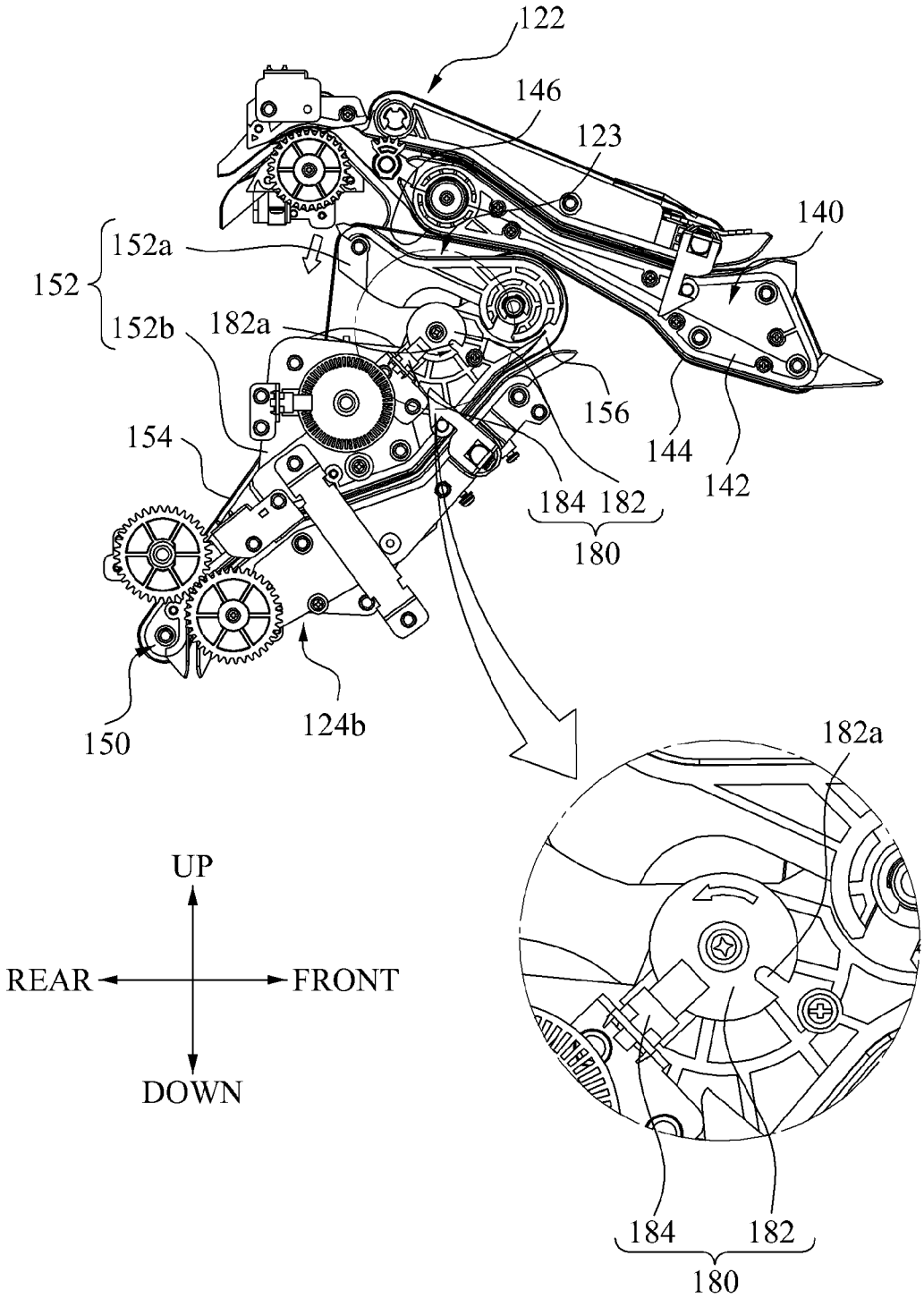

Referring to FIG. 8 and FIG. 9, after separating the stopping hook 172 from the guide protrusion 174 by rotating the locking portion 170, the knob 166 may be rotated into the direction in which the escrow transfer path 123 is to open. When the knob 166 is rotated until the guide protrusion 174 is stopped by the guide hole 167 of the guide portion 166*b*, the rotation shaft 162, the rotation cam 164, and the sensing plate 182 may rotate with the knob 166.

When the rotation cam 164 rotates as above, the rotation frame 152*a* of the second transfer portion 150 may rotate into a direction in which the rotation frame 152*a* is to be alienated from the first transfer portion 140 by the tension of the second transfer belt 154 and the elastic force of the elastic member 168. In this instance, in an initial stage of rotation of the knob 166, the roller member 158 of the rotation frame 152*a* may contact with the first contact portion 164*a* of the rotation cam 164. In the rotation of the knob 166, the roller member 158 of the rotation frame 152*a* may move along the rotation cam 164. In a final stage of rotation of the knob 166, the roller member 158 of the rotation frame 152*a* may contact with the second contact portion 164*b* of the rotation cam 164. Accordingly, the escrow transfer path 123 formed between the first transfer portion 140 and the second transfer portion 150 may open. Through the open portion of the escrow transfer path 123, it is possible to directly verify whether the jam has occurred with bare eyes, and to put a hand and pull out jammed paper media.

Also, when the sensing plate 182 rotates, the slit 182*a* of the sensing plate 182 may move whereby the light from the light emitter 186 may not be sensed at the light receiver 188. Accordingly, the depositing device 100 may recognize that the escrow transfer path 123 is open and thereby, suspend all the transfer operation of paper media.

Meanwhile, when the jam is removed in the media transfer device 120, 122, 124, or 126, the knob 166 may rotate into an opposite direction, that is, a direction in which the rotation frame 152*a* may closely contact with the first transfer portion 140, until the stopping hook 172 of the locking portion 170 is stopped by the guide protrusion 174.

As the knob 166 rotates, the stopping hook 172 of the locking portion 170 may interfere with the guide protrusion 174. Due to the interference between the stopping hook 172 and the guide protrusion 174, the locking portion 170 may elastically rotate and then, the stopping hook 172 may be stopped by the guide protrusion 174 and thereby be fixed. Since the rotation operation of the opening and closing portion 160 is in a locked state by the locking portion 170, it is possible to prevent the escrow transfer path 123 from arbitrarily being opened.

As described above, as the knob 166 rotates, the rotation shaft 162, the rotation cam 164, and the sensing plate 182 may also rotate in the direction opposite to the rotation direction of the knob 166. When the rotation cam 164 rotates, the rotation frame 152*a* may rotate in the direction in which the rotation frame 152*a* and the first transfer portion 140 closely contact with each other due to the interference between the rotation cam 164 and the rotation frame 152*a*. Here, in an initial stage of rotation of the knob 166, the roller member 158 of the rotation frame 152*a* may contact with the first contact portion 164*a* of the rotation cam 164. In the rotation of the knob 166, the roller member 158 of the rotation frame 152*a* may move along the rotation cam 164. In a final stage of rotation of the knob 166, the roller member 158 of the rotation frame 152*a* may contact with the first contact portion 164*a* of the rotation cam 164. Accordingly, the first transfer portion 140 and the second transfer portion 150 may be disposed to closely contact with each other whereby the escrow transfer path 123 may be formed between the first transfer portion 140 and the second transfer portion 150. Paper media may be transferred through the escrow transfer path 123.

Also, when the sensing plate 182 rotates into the opposite direction, the slit 182*a* of the sensing plate 182 may move whereby the light from the light emitter 186 may be sensed at the light receiver 188 through the slit 182*a*. Accordingly, the depositing device 100 may recognize that the state of the escrow transfer path 123 is normal and then, may operate the media transfer device 120, 122, 124, or 126.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents. That is, the media transfer device of the present invention may be applicable to a media transfer device of a withdrawing device or a depositing and withdrawing device, in addition to the depositing device, and may be formed in a second transfer portion disposed in each of a plurality of portions where a jam may highly probably occur.

The invention claimed is:

1. A media transfer device of an automatic teller machine (ATM), the media transfer device comprising:

a first transfer portion supporting one surface of a paper medium, the first transfer portion comprising a first transfer frame configured to rotatably mount first transfer rollers and a first transfer belt mounted on the first transfer roller to rotate in one direction;

a second transfer portion comprising:

a rotation frame facing the first transfer portion and supporting another surface of the paper medium to transfer the paper medium in conjunction with the first transfer portion in an engaged state, a support frame rotatably supporting the rotation frame, second transfer rollers mounted to the rotation frame or the support frame, and a second transfer belt mounted to the second transfer rollers to rotate in another direction and engaging the first transfer belt in the engaged state, tension of the second transfer belt causing the rotation frame to rotate into a disengaged state for removing a jammed paper medium;

an opening and closing portion mounted to the second transfer portion and enabling rotation of the rotation frame of the second transfer portion between the engaged state and the disengaged state, the opening and closing portion comprising:

a rotation shaft rotatably mounted to the support frame, a rotation cam mounted to the rotation shaft, the rotation cam configured to contact a roller member of the rotation frame and cause the rotation frame to rotate based on a rotation angle of the rotation shaft, a knob at one end of the rotation shaft, the knob comprising a grip portion at the end of the rotation shaft to rotate the rotation shaft and a guide portion formed in the grip portion to guide rotating of the rotation shaft, and an elastic member mounted to the rotation frame and the support frame to exert force in a direction of moving the rotation frame into the disengaged state; and a locking portion at one side of the opening and closing portion to lock the second transfer portion in the engaged state, the locking portion comprising a guide protrusion formed in a housing to receive the first transfer portion and the second transfer portion, and a guide hole with a predetermined length is formed in the guide portion for receiving the guide protrusion to limit a rotatable angle of the rotation shaft.

2. The media transfer device of claim 1, wherein: one end of the locking portion is elastically rotatably mounted to the guide portion or the grip portion, and another end of the locking portion comprises a stopping hook engaged by an end of the guide protrusion passing through the guide hole to be fixed in the engaged state.

3. The media transfer device according to claim 1, further comprising:

a sensing portion disposed at another side of the opening and closing portion to sense the engaged state and the disengaged state the sensing portion comprises comprising:

a sensing plate disposed on another end of the rotation shaft to rotate together with the rotation shaft and formed with a slit on one side of the sensing plate, and a sensor comprising a light emitter disposed to face one side of the sensing plate and a light receiver disposed to face another surface of the sensing plate and to sense light of the emitter passing through the slit.

* * * * *